US005449118A

United States Patent [19]

Baker

[11] Patent Number: 5,449,118

[45] Date of Patent: Sep. 12, 1995

[54] APPARATUS FOR CONTROLLING THE RATE OF FEEDING OF A ROD OF HEAT FUSIBLE MATERIAL

[76] Inventor: Edgar C. Baker, Rd #5, Box 584, Blairsville, Pa. 15717

[21] Appl. No.: 259,729

[22] Filed: Jun. 14, 1994

[51] Int. Cl.[6] ..... B05B 7/18; B05C 5/04

[52] U.S. Cl. ..... 239/84; 226/42

[58] Field of Search ..... 239/83, 84, 71, 73; 226/42, 43, 45, 178, 188

[56] References Cited

U.S. PATENT DOCUMENTS

| | | | |
|---|---|---|---|
| 3,632,952 | 1/1972 | Rotolico et al. | 219/76 |
| 4,024,369 | 5/1977 | Thompson et al. | 219/76 |
| 4,107,508 | 8/1978 | Izumi et al. | 226/178 |
| 4,325,512 | 4/1982 | Kenshol | 239/84 |
| 4,624,410 | 11/1986 | Rogers | 239/83 |
| 4,668,852 | 5/1987 | Fox et al. | 219/76.14 |
| 4,673,139 | 6/1987 | Memminger et al. | 226/42 |
| 4,853,513 | 8/1989 | Fuimefreddo | 219/76.14 |
| 4,932,581 | 6/1990 | Ohle et al. | 226/43 |
| 4,944,464 | 7/1990 | Zelenka | 226/188 |
| 4,992,337 | 2/1991 | Kaiser et al. | 428/642 |
| 5,191,186 | 3/1993 | Crapo, III et al. | 219/76.16 |
| 5,275,336 | 1/1994 | Stasi et al. | 239/84 |

*Primary Examiner*—Karen B. Merritt

*Attorney, Agent, or Firm*—Michael R. Swartz; John R. Flanagan

[57] ABSTRACT

A control apparatus is coupled to a flame spray gun for controlling the rate of feeding of a rod of heat fusible material through the gun. The control apparatus includes an electric motor adapted to be drivingly coupled to a flame spray gun and being operable in response to application of a D.C. voltage thereto to generate rotary motion to produce and control feeding of a rod of heat fusible material through the flame spray gun, an A.C. to D.C. converter and regulator device for generating and applying the D.C. voltage to the electric motor, a manually adjustable potentiometer connected to the converter and regulator to vary the quantity of D.C. voltage output applied to the electric motor and thereby control the rate of rotary motion produced by the electric motor, a tachometer coupled to the electric motor for sensing the rotary motion produced by the electric motor and, in response thereto, generating a feedback voltage signal representing the rate of rotary motion produced by the electric motor and thereby the rate of feeding of the rod of heat fusible material through the flame spray gun, and a digital display coupled to the tachometer and receiving the feedback signal therefrom, the digital display being adapted to produce a readout of the feed rate in response to the feedback signal.

17 Claims, 4 Drawing Sheets

APPARATUS FOR CONTROLLING THE RATE OF FEEDING OF A ROD OF HEAT FUSIBLE MATERIAL

BACKGROUND OF THE INVENTION

1. Field of the Invention

The present invention generally relates to a flame spray gun for feeding and melting a rod of heat fusible material and spraying molten droplets thereof onto a substrate to form a protective coating thereon and, more particularly, is concerned with a control apparatus coupled to the gun for controlling the rate of feeding of the rod of heat fusible material through the gun.

2. Description of the Prior Art

Thermal spraying, also known as flame spraying, involves the heat softening of a heat fusible material, such as metal or ceramic, and propelling the softened material in particulate or droplet form against a surface which is to be coated. The heated particles strike the surface where they are quenched and bonded thereto to form a protective coating thereon. A thermal or flame spray gun is typically used for both heating and propelling the particles.

In the flame spray gun disclosed in U.S. Pat. No. 4,325,512 to Kenshol, the heat fusible material in rod form is fed into a combustion head by a pair of feed rolls driven by an air-driven turbine. The leading tip of the rod of heat fusible material is softened and melted by a flame in the combustion head and is atomized by an atomizing blast gas, such as compressed air, delivered to a spray head. The atomized material in finely divided particles or droplets is propelled from the spray head by the blast gas onto a surface to be coated. The spray head includes a spray nozzle and a gas cap for providing an annular flame around the axially fed rod of heat fusible material.

Several problems have been experienced with the flame spray gun of the above-cited Kenshol patent which appear to arise from the use of the air-driven turbine or motor and result in the production of a coating of poor quality. The first problem relates to the introduction of contaminants, such as dirt, oil and grease, into the gun with the air drawn in by the air-driven motor. Such introduction of contaminants adversely affects the speed and performance of the motor and produces flaws, such as pitting and unevenness, in the coating. The second problem relates to the variation in rate of feeding of the rod of heat fusible material produced by the inability to effectively control the volume and pressure of the air used to drive the motor. Such variation in feeding rate translates into variation in the rate of atomization of the rod which prevents the achievement of a consistent or uniform thickness in the coating produced on the surface being coated.

The thermal or flame spray gun disclosed in U.S. Pat. No. 5,275,336 to Stasi et al would appear to overcome the first problem described above relating to introduction of contaminants into the coating in that an electric motor is used instead of the air-driven turbine to drive the feed rolls to feed the rod of heat fusible material. The electric motor is not air-driven and so the introduction of contaminants by air is avoided.

However, the Stasi et al patent does not recognize the second problem and so does not disclose or suggest a solution to it. Consequently, a need still exists for improvement of the flame spray process as performed by use of a flame spray gun of the aforementioned type wherein the rate of feeding of the rod of heat fusible material through the gun is precisely controlled such that the result is the production of a precise high quality coating.

SUMMARY OF THE INVENTION

The present invention provides a feed rate control apparatus designed to satisfy the aforementioned needs. The feed rate control apparatus of the present invention includes an electric motor for retrofitting an existing flame spray gun to replace an air-driven motor or turbine and thereby avoid the problems associated with the use of the air-driven turbine. Also, the feed rate control apparatus includes other electrical components for precisely controlling the operation of the electric motor and thereby precisely controlling the rate of feeding of the rod of heat fusible material through the gun and the rate of atomizing of the rod into particles of heat fusible material. The provision of such features results in a flame spraying process which produces a coating of vastly improved quality by ensuring a consistent thickness in the coating applied and by eliminating the formation of pits and imperfections therein.

Accordingly, the present invention is directed to a control apparatus which is retrofitted or coupled to a flame spray gun for controlling the rate of feeding of a rod of heat fusible material through the gun. The control apparatus comprises: (a) an electric motor adapted to be drivingly coupled to a flame spray gun and being operable in response to application of a D.C. voltage thereto to generate rotary motion to produce and control feeding of a rod of heat fusible material through the flame spray gun; (b) means connected to the electric motor for generating a D.C. voltage output and applying the D.C. voltage output to the electric motor; (c) means connected to the D.C. voltage output generating and applying means for adjusting the D.C. voltage output generating and applying means to vary the quantity of D.C. voltage output applied to the electric motor and thereby control the rate of rotary motion produced by the electric motor; and (d) means connected to the electric motor for sensing the rotary motion produced by the electric motor and, in response thereto, for displaying the rate of the rotary motion and thereby the rate of feeding of the rod of heat fusible material through the flame spray gun.

More particularly, the D.C. voltage output generating and applying means includes means for supplying a source of A.C. electrical power, means for receiving an A.C. power input therefrom and for converting the A.C. power input to the D.C. voltage output, and means for varying and regulating the D.C. voltage applied to the electric motor. The means for adjusting the D.C. voltage output generating and applying means is a manually adjustable potentiometer. The means connected to the electric motor for sensing the rotary motion produced by the electric motor and displaying the rate thereof produced by the electric motor includes a tachometer coupled to the electric motor for sensing the rotary motion produced by the electric motor and, in response thereto, generating a feedback voltage signal representing the rate of rotary motion produced by the electric motor and thereby the rate of feeding of the rod of heat fusible material through the flame spray gun, and a digital display coupled to the tachometer and receiving the feedback signal therefrom, the digital display being adapted to produce a readout of the feed rate in response to the feedback signal.

The feed rate control apparatus further comprises a casing containing the A.C. to D.C. converting and regulating power supply components therein and mounting the digital display and manually adjustable potentiometer thereon in a manner accessible from an exterior thereof. Further, an A.C. electrical power input connector is mounted on the casing in a manner accessible from the exterior thereof and is electrically connected to the A.C. to D.C. converting and regulating power supply components contained within the casing. Another electrical connector is mounted on the casing in a manner accessible from the exterior thereof and is electrically connected to the digital display mounted on the casing.

The present invention is also directed to a flame spray system which comprises the combination of the above-defined feed rate control apparatus and the flame spray gun. The flame spray gun includes a gun body, a combustion head on the gun body, a spray head extending from the combustion head, means for supplying flows of air, fuel and oxidant through the gun body to the combustion head for supporting and generating a flame in the combustion head, and means for delivering a rod of heat fusible material through the gun body and into the combustion head where a leading tip of the rod of heat fusible material is softened and melted by the flame in the combustion head and is atomized into finely divided particles and propelled by the spray head therefrom onto a surface to be coated. The delivering means includes a rotatable coupler element adapted to be drivingly coupled to the electric motor and rotated thereby to cause transmission of rotary motion to advance the rod to the combustion head at the rate regulated by the feed rate control apparatus.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
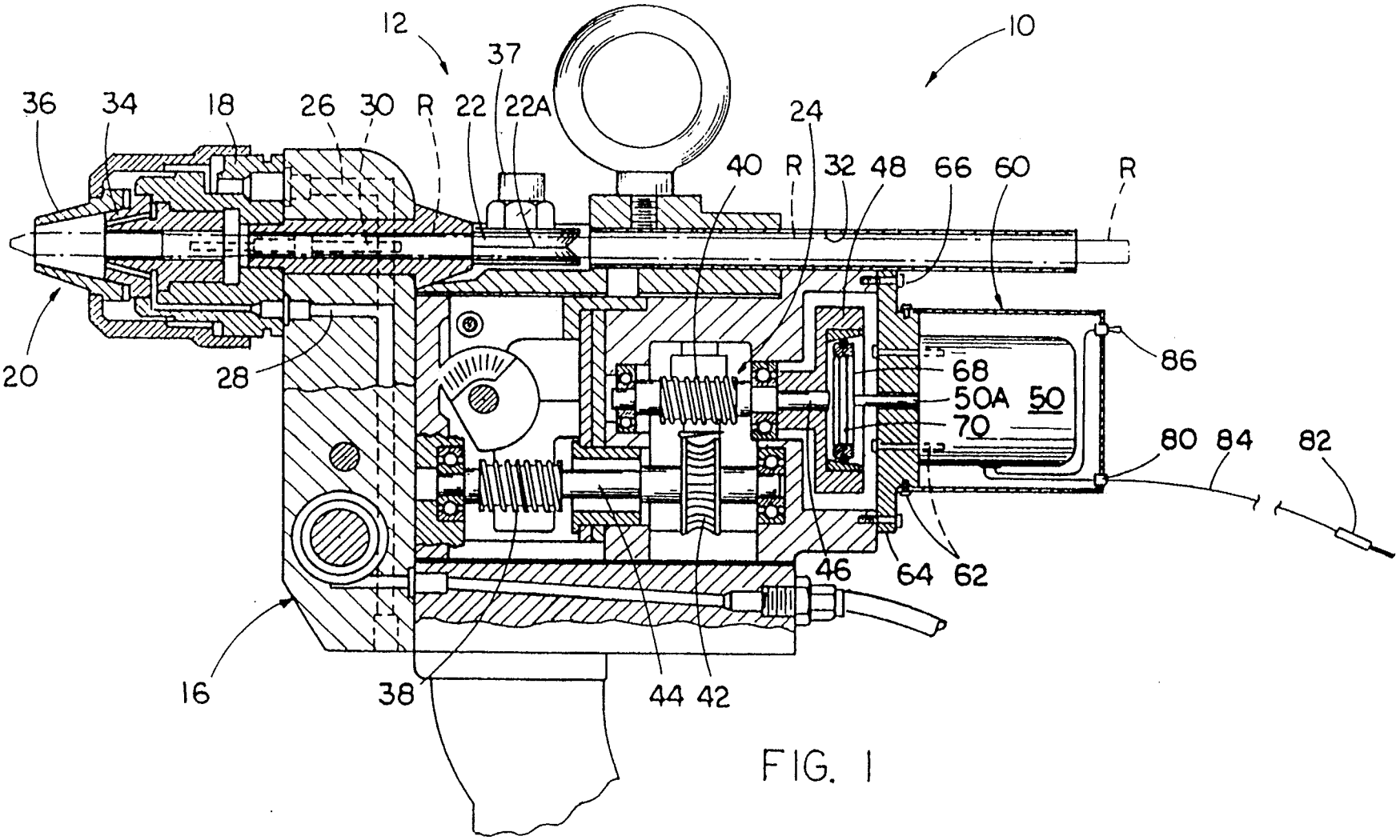
FIG. 1 is a vertical sectional view of a flame spray gun retrofitted with an electric motor of a feed rate control apparatus of the present invention to drive a gear train of the gun and whose operation is precisely controlled by electrical components of the feed rate control apparatus which are not shown in FIG. 1.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Flame Spray Gun

Figure 2:
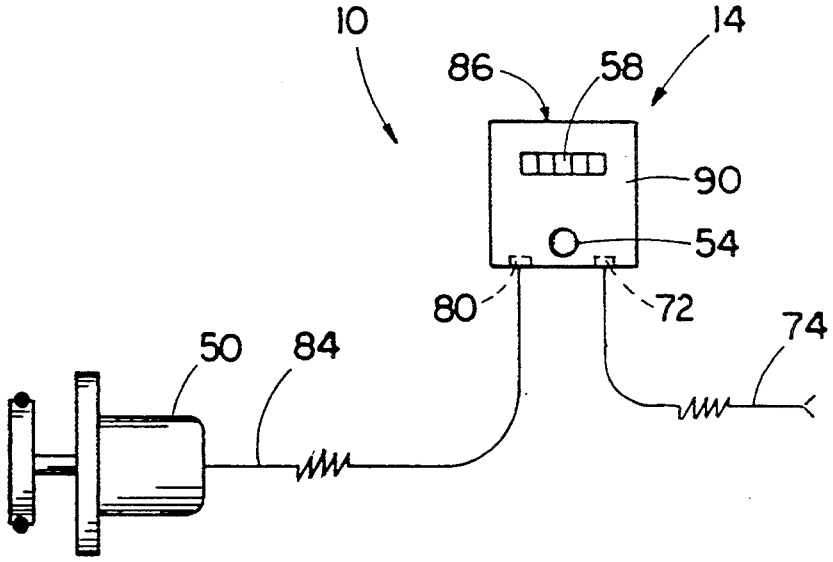
FIG. 2 is an assembled elevational view of the feed rate control apparatus.
Figure 3:
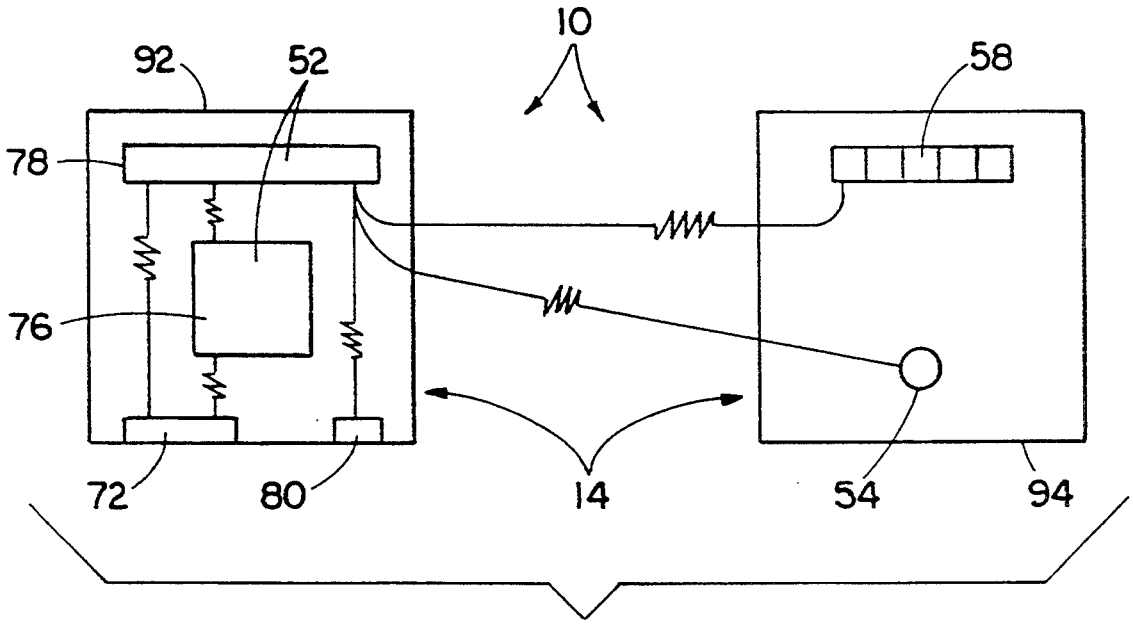
FIG. 3 is disassembled elevational view of the feed rate control apparatus.

Referring now to the drawings, and particularly to FIGS. 1 to 3, there is illustrated a flame spray system of the present invention, being generally designated 10. The flame spray system 10 of the present invention basically includes a flame spray gun 12 and a feed rate control apparatus 14 also of the present invention. The flame spray gun 12 is operable for feeding and melting a rod R of heat fusible material and spraying molten droplets or particles thereof onto a substrate (not shown) to form a protective coating thereon.

The flame spray gun 12 shown in FIG. 1 is generally the same as the flame spray gun illustrated and described in aforesaid U.S. Pat. No. 4,325,512 (the disclosure of which is incorporated herein by reference), except that the flame spray gun 12 is now retrofitted with the feed rate control apparatus 14 for controlling the rate of feeding of the rod R of heat fusible material through the flame spray gun 12 in accordance with the principles of the present invention. The parts of the flame spray gun 12 which are common with the flame spray gun of aforesaid U.S. Pat. No. 4,325,512 will only be described hereinafter to the extent necessary to facilitate a complete understanding of the feed rate control apparatus 14 of the present invention.

Referring to FIG. 1, the flame spray gun 12 basically includes a gun body 16, a combustion head 18 on the gun body 16, a spray head 20 extending from combustion head 18, a pair of feed rolls 22, and a gear train 24 drivingly coupled to the feed rolls 22. The gun body 16 also has respective air, fuel and oxidant flow passages 26, 28, 30 defined therein which lead from the exterior of the gun body 16 through the interior thereof to the combustion head 18 for supplying the constituents necessary to support combustion and generation of a flame in the combustion head 18. Also, a feed passage 32 is provided through the gun body 16 for guiding the rod R of heat fusible material from the exterior of the gun body 16 through the interior thereof between and past the pair of feed rolls 22 and into the combustion head 18. The leading tip of the rod R of heat fusible material is softened and melted by a flame in the combustion head and is atomized by an atomizing blast gas, such as compressed air, delivered to the spray head 20. The atomized material in finely divided particles or droplets is propelled from the spray head 20 by the blast gas onto a surface to be coated. The spray head 20 includes a spray nozzle 34 and a gas cap 36 for providing an annular flame around the axially fed rod R of heat fusible material.

The gear train 24 which is drivingly coupled with the feed rolls 22 includes a pair of shafts 37 mounting the respective feed rolls 22 in a side-by-side relationship to one another, a pair of worm gears 38, 40, a worm wheel 42 and a pair of shafts 44, 46 rotatably mounted to the interior of the gun body 16 and, in turn, mounting the worm gears 38, 40 and worm wheel 42. The feed rolls 22 on the shafts 37 have annular V-grooves 22A and are provided in frictional engagement with opposite sides of the rod R. The gear train 24 also includes a cup-shaped female coupler 48 attached on a rear end of the shaft 46. Upon rotation of the female coupler 48, rotary motion is transmitted in a known manner via the other above-mentioned components of the gear train 24 to the pair of feed rolls 22 which advance the rod R through the feed passage 32 to the combustion head 18.

Feed Rate Control Apparatus

Referring to FIGS. 2–5, there is illustrated the feed rate control apparatus 14 of the present invention adapted for retrofitting or coupling to the flame spray gun 12 of FIG. 1 for controlling the rate of feeding of the rod R of heat fusible material through the gun body 16. In its basic components, the feed rate control apparatus 14 includes an electric motor 50, an A.C. to D.C. convertor and regulator device 52, a manually adjustable potentiometer 54, a tachometer 56 and a digital display 58. Preferably, the electric motor 50 is a high speed motor with an input voltage of 0–28 VDC and an RPM of 0–24,000 and with the tachometer 56 being built into the motor.

Referring again to FIG. 1, the electric motor 50 is enclosed in a housing 60 and both the electric motor 50 and housing 60 are attached by fasteners 62 to a base member 64 which, in turn, is attached by fasteners 66 to the gun body 16 of the flame spray gun 12, facing toward the rotatable female coupler 48 of the gear train 24 which defines the means for delivering the rod R through the feed passage 32 of the gun body 16. The electric motor 50 includes a rotary output shaft 50A and a pulley 68 attached on the outer end of the shaft 50 and having an annular shaped element 70, such as an O-ring, mounted about the periphery of the pulley 68 for frictionally and drivingly mating within the female coupler 48 of the gear train 24 when the base member 64 is fastened to the gun body 16. The electric motor 50 is operable in response to application of a D.C. voltage thereto to generate rotary motion by rotating its output shaft 50A and the pulley 68 thereon so as to cause rotation of the female coupler 48 which, in turn, via the gear train 24 produces and controls feeding of the rod R of heat fusible material through the feed passage 32 of the gun body 16.

Figure 4:
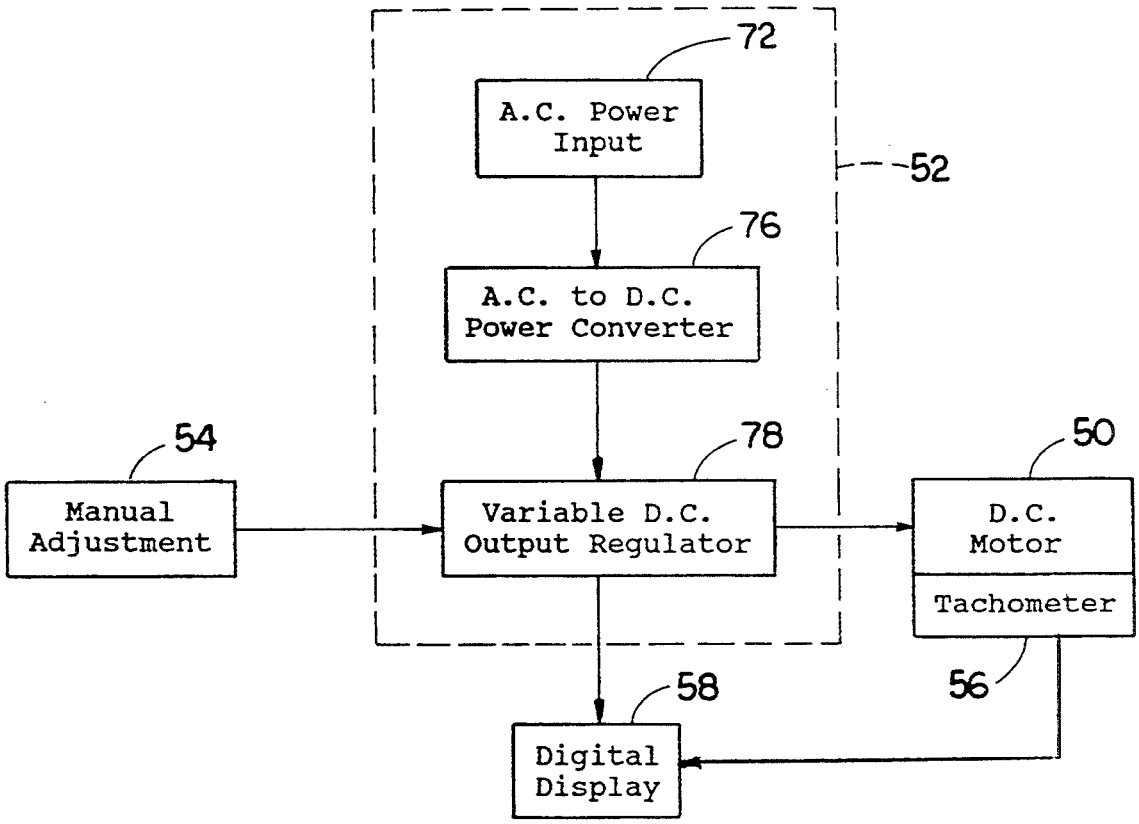
FIG. 4 is a block diagram of the electrical components of the feed rate control apparatus.
Figure 5:
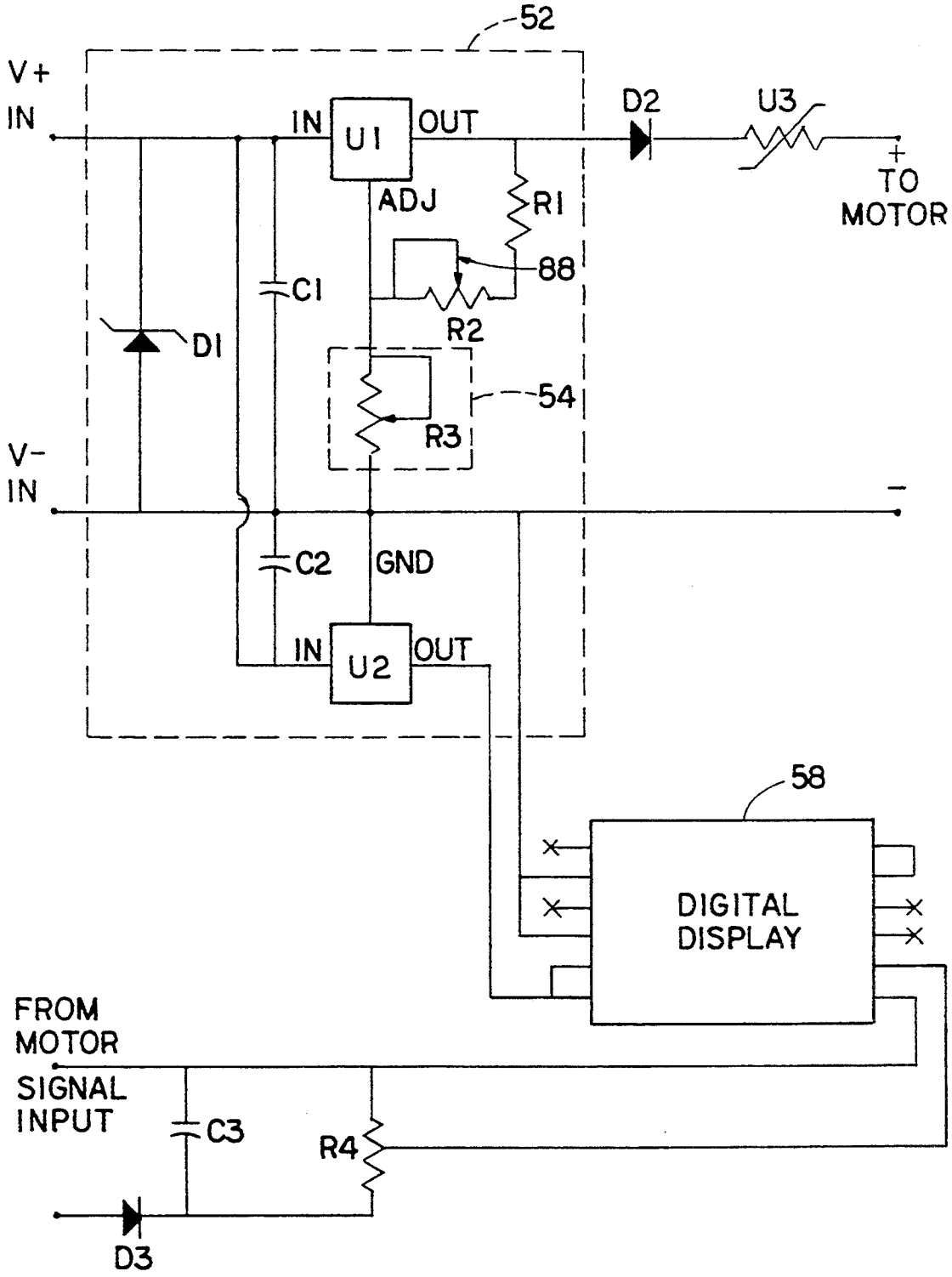
FIG. 5 is a detailed circuit diagram of the electrical components of the feed rate control apparatus.

Referring to FIGS. 3–5, the A.C. to D.C. voltage converter and regulator device 52 for generating and applying the D.C. voltage to the electric motor 50 includes means in the form of an A.C. electrical power input connector 72 for supplying a source of A.C. electrical power, such as via an electrical power cord 74 connected to a conventional A.C. electrical power outlet (not shown), means 76 for receiving A.C. power input and converting the A.C. electrical power input to the D.C. voltage output, and means 78 for varying and regulating the D.C. voltage which is applied to the electric motor 50. Another electrical connector 80 is connected to the A.C. to D.C. voltage converter and regulator device 52 and is adapted to receive an electrical plug 82 on the end of another power cord 84 electrically connected to the electric motor 50. An off/on electrical switch 86 is mounted on the motor housing 60 for actuating the electric motor between on and off conditions. In addition, the switch may contain a pilot light (not shown) which informs the operator that power is being supplied to the motor. The manually adjustable potentiometer 54, or a similarly functioning device, is connected to the D.C. voltage varying and regulating means 78 and upon rotation by a user is adapted to vary the quantity of D.C. voltage output applied by variable D.C. output regulator means 78 to the electric motor 50 and thereby control the rate of rotary motion of the shaft 50A produced by the electric motor 50. As seen in FIG. 5, the adjustable D.C. voltage regulator means 78 also includes another internal potentiometer 88 which can be adjusted to preset the output of the device 52 to conform to the particular electrical requirements of different countries in which the flame spray system 10 of the present invention might be used. The tachometer 56, which is conventional per se and of well-known construction, is coupled to the electric motor 50 for sensing the rotary motion of the output shaft 50A produced by the electric motor 50 and, in response thereto, generating a feedback voltage signal representing the rate of rotary motion produced by the electric motor 50 and thereby the rate of feeding of the rod R of heat fusible material through the flame spray gun 12. The digital display 58 electrically coupled to the tachometer 56 and receives the feedback signal therefrom, the digital display 58 being adapted to produce a digital readout of the feed rate in response to the feedback signal.

The feed rate control apparatus 14 further comprises a casing 90 having base 92 and a removable cover 94. The feed rate control apparatus 14 contains the A.C. to D.C. converter and regulator device 52 and mounts the digital display 58 and manually adjustable potentiometer 54 thereon in a manner accessible from an exterior thereof. The A.C. electrical power input connector 72 is mounted on the casing 90 in a manner accessible from the exterior thereof and is electrically connected to the A.C. to D.C. converter and regulator device 52 contained within the casing 90. The other electrical connector 80 is mounted on the casing 90 in a manner accessible from the exterior thereof and is electrically connected to the digital display 58 mounted on the casing 90. Additionally, the digital display and potentiometer 58, 54 are mounted on the cover 94 of the casing 90. Thus, both reading and regulating the feed rate control apparatus 14 is relatively convenient and easy.

As mentioned above, the flame spray system 10 of the present invention includes the combination of the above-defined feed rate control apparatus 14 and the flame spray gun 12 being retrofitted with the feed rate control apparatus 14. The material making up the rod R can be a variety of suitable materials. One such material is a suitable ceramic.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A control apparatus for controlling the rate of feeding of a rod of heat fusible material through a flame spray gun, said control apparatus comprising:

(a) an electric motor having a rotary output shaft adapted to be drivingly coupled to a flame spray gun and being operable in response to application of a D.C. voltage thereto to generate rotary motion to produce and control feeding of a rod of heat fusible material through the flame spray gun;

(b) means connected to said electric motor for generating a D.C. voltage output and applying said D.C. voltage output to said electric motor;

(c) means connected to said D.C. voltage output generating and applying means for adjusting said D.C. voltage output generating and applying means to vary the quantity of D.C. voltage output applied to said electric motor and thereby control the rate of rotary motion of said rotary output shaft of said electric motor; and (d) means connected to said electric motor for sensing the rotary motion of said rotary output shaft of said electric motor and, in response thereto, for displaying the rate of rotary motion produced by said electric motor and thereby the rate of feeding of the rod of heat fusible material through the flame spray gun;

(e) said rotary motion sensing means including a tachometer coupled to said electric motor for sensing the rotary motion of said rotary output shaft of said electric motor and, in response thereto, generating a feedback voltage signal representing the rate of the rotary motion of said rotary output shaft of said electric motor and thereby the rate of feeding of the rod of heat fusible material through the flame spray gun.

2. The apparatus as recited in claim 1, wherein said D.C. voltage output generating and applying means includes a source of D.C. electrical power.

3. The apparatus as recited claim 2, wherein said D.C. voltage output generating and applying means includes means for supplying a source of A.C. electrical power and means for receiving an A.C. power input from said supplying means and for converting said A.C. power input to said source of D.C. electrical power.

4. The apparatus as recited in claim 1, wherein said D.C. voltage output generating and applying means includes an A.C. to D.C. converting and regulating power supply.

5. The apparatus as recited in claim 4, wherein said means for adjusting said D.C. voltage output generating and applying means is a manually adjustable potentiometer.

6. The apparatus as recited in claim 5, further comprising:

a casing containing said A.C. to D.C. converting and regulating power supply therein and mounting said manually adjustable potentiometer thereon in a manner accessible from an exterior thereof.

7. The apparatus as recited in claim 6, further comprising:

an A.C. electrical power input connector mounted on said casing in a manner accessible from said exterior thereof and being electrically connected to said A.C. to D.C. converting and regulating power supply.

8. The apparatus as recited in claim 6, further comprising:

an electrical connector mounted on said casing in a manner accessible from said exterior thereof and being electrically connected to said rotary motion sensing means.

9. The apparatus as recited in claim 1, wherein said means connected to said electric motor for sensing the rotary motion produced by said electric motor and displaying the rate thereof produced by said electric motor also includes a digital display coupled to said tachometer and receiving said feedback signal therefrom, said digital display adapted to produce a readout of the feed rate in response to said feedback signal.

10. The apparatus as recited in claim 1, wherein said means for adjusting said D.C. voltage output generating and applying means is a manually adjustable potentiometer.

11. A flame spray system, comprising:

(a) a flame spray gun, said gun including (i) a gun body, (ii) a combustion head on said gun body, (iii) a spray head extending from said combustion head, (iv) means for supplying flows of air, fuel and oxidant through said gun body to said combustion head for supporting and generating a flame in said combustion head, and (v) means for delivering a rod of heat fusible material through said gun body and into said combustion head where a leading tip of said rod of heat fusible material is softened and melted by said flame in said combustion head and is atomized into finely divided particles and propelled by said spray head therefrom onto a surface to be coated, said delivering means including a rotatable coupler element adapted to be rotated and cause transmission of rotary motion to advance the rod to said combustion head; and (b) a control apparatus drivingly coupled to said flame spray gun and being operable to control the rate of feeding of the rod of heat fusible material through said gun body, said control apparatus including (i) an electric motor drivingly coupled to said rotatable coupler element of said delivering means of said flame spray gun and being operable in response to application of a D.C. voltage thereto to produce rotary motion and rotate said coupler element and thereby control the feeding of the rod of heat fusible material through said flame spray gun, (ii) means connected to said electric motor for generating a D.C. voltage output and applying said D.C. voltage output to said electric motor, (iii) means connected to said D.C. voltage output generating and applying means for adjusting said D.C. voltage output generating and applying means to vary the quantity of D.C. voltage output applied to said electric motor and thereby control the rate of rotary motion produced by said electric motor, and (iv) means connected to said electric motor for sensing the rotary motion produced by said electric motor and, in response thereto, for displaying the rate of rotary motion produced by said electric motor and thereby the rate of feeding of the rod of heat fusible material through the flame spray gun.

12. The apparatus as recited claim 11, wherein said D.C. voltage output generating and applying means includes means for supplying a source of A.C. electrical power and means for receiving an A.C. power input from said supplying means and for converting said A.C. power input to said D.C. voltage output and regulating said D.C. voltage output in response to said A.C. power input.

13. The apparatus as recited in claim 12, wherein said means for adjusting said D.C. voltage output generating and applying means is a manually adjustable potentiometer connected to said A.C. to D.C. converting means.

14. The apparatus as recited in claim 13, wherein said means connected to said electric motor for sensing the rotary motion produced by said electric motor and displaying the rate thereof produced by said electric motor includes a tachometer coupled to said electric motor for sensing the rotary motion produced by said electric motor and, in response thereto, generating a feedback voltage signal representing the rate of the rotary motion produced by said electric motor and thereby the rate of feeding of the rod of heat fusible material through the flame spray gun.

15. The apparatus as recited in claim 14, wherein said means connected to said electric motor for sensing the rotary motion produced by said electric motor and displaying the rate thereof produced by said electric motor also includes a digital display coupled to said tachometer and receiving said feedback signal therefrom, said digital display adapted to produce a readout of the feed rate in response to said feedback signal.

16. The apparatus as recited in claim 15, further comprising:

a casing containing said A.C. to D.C. converting and regulating power supply therein and mounting said digital display and said manually adjustable potentiometer thereon in a manner accessible from an exterior thereof.

17. The apparatus as recited in claim 16, further comprising:

an A.C. electrical power input connector mounted on said casing in a manner accessible from said exterior thereof and being electrically connected to said A.C. to D.C. converting and regulating power supply; and an electrical connector mounted on said casing in a manner accessible from said exterior thereof and being electrically connected to said digital display.

* * * * *